United States Patent [19]

Saunders

[11] Patent Number: 5,038,956

[45] **Date of Patent: * Aug. 13, 1991**

[54] ABUSE RESISTANT, SAFETY-EDGE, CONTROLLED-OPENING CONVENIENCE-FEATURE END CLOSURES

[75] Inventor: William T. Saunders, Weirton, W. Va.

[73] Assignee: Weirton Steel Corporation, Weirton, W. Va.

[ * ] Notice: The portion of the term of this patent subsequent to Feb. 14, 2006 has been disclaimed.

[21] Appl. No.: 382,624

[22] PCT Filed: Jul. 22, 1988

[86] PCT No.: PCT/US88/02512

§ 371 Date: Apr. 26, 1989

§ 102(e) Date: Apr. 26, 1989

[87] PCT Pub. No.: WO89/02854

PCT Pub. Date: Apr. 6, 1989

Related U.S. Application Data

[63] Continuation-in-part of Ser. No. 147,267, Jan. 22, 1988, Pat. No. 4,804,106.

[51] Int. Cl.[5] ..... B65D 17/34

[52] U.S. Cl. ..... 220/271; 220/270; 220/273; 220/276; 220/90.6; 413/12; 413/14

[58] Field of Search ..... 220/260, 269, 270, 271, 220/272, 273, 276, 285, 90.6; 413/12, 14, 17, 67, 68

[56] References Cited

U.S. PATENT DOCUMENTS

| | | | |
|---|---|---|---|
| Re. 30,349 | 7/1980 | Silver | 220/271 |
| 3,527,378 | 9/1970 | Scharf et al. | 220/273 |
| 3,544,025 | 12/1970 | La Croce et al. | 220/273 |
| 3,696,961 | 10/1972 | Holk, Jr. | 220/269 |
| 3,939,787 | 2/1976 | Morrison et al. | 413/14 X |
| 4,052,949 | 10/1977 | Woodley | 413/14 X |
| 4,386,713 | 6/1983 | Baumeyer et al. | 220/269 |
| 4,804,106 | 2/1989 | Saunders | 220/273 |
| 4,848,623 | 7/1989 | Saunders et al. | 220/273 |

*Primary Examiner*—Stephen Marcus
*Assistant Examiner*—Nova Stucker
*Attorney, Agent, or Firm*—Raymond N. Baker

[57] ABSTRACT

A convenience-feature full-open end closure structure (27) with a shock-absorbing bead (45) located between a peripheral scoreline (34) which defines the end wall disc (31) to be removed from a recessed end wall panel (49). An arch-shaped back scoreline means with central vent portion (36) and legs (37, 38) is located within the removable disc (31) and co-acts with a longitudinally rigid (non-lanced) opener (30) which is made integral by a rivet (32) formed from sheet metal of disc (31). A multi-layer sheet metal fold (40) shields the raw edge of ruptured residual peripheral scoreline metal which remains with disc (31); and a multi-layer sheet metal fold (42) shields residual raw-edge metal remaining with container (94). The back scoreline central portion (36) is contiguous to and radially inward of rivet (32) and the pair of legs (37, 38) extend with a radially-directed component on opposite sides of the rivet toward the adjacent portion of the peripheral chime seam (92). Such legs (37, 38) intersect multi-layer fold (40) forming a chord (88, 90) of preselected length about which such opener (30) rotates to provide continued lever action severance of such peripheral scoreline (34).

4 Claims, 6 Drawing Sheets

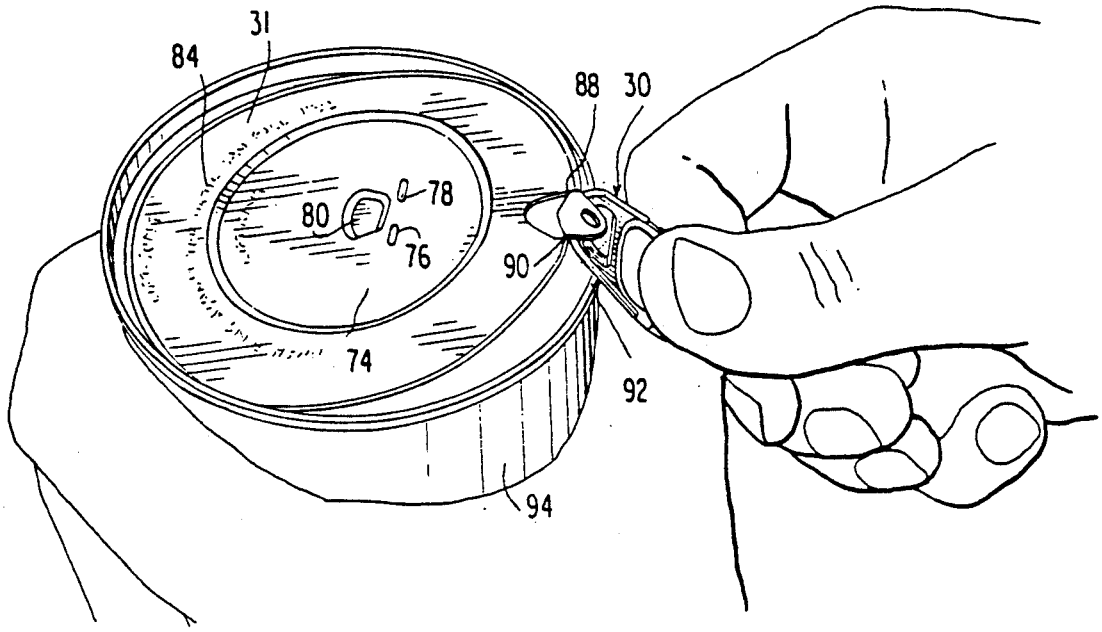
FIG. 16
FIG. 17
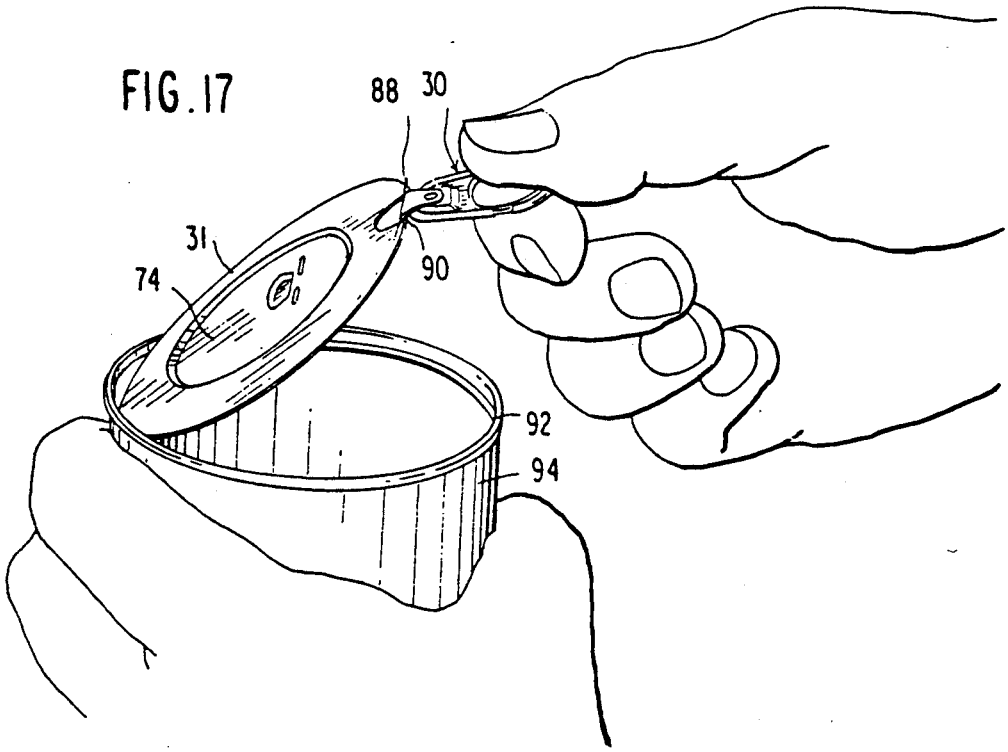

ABUSE RESISTANT, SAFETY-EDGE, CONTROLLED-OPENING CONVENIENCE-FEATURE END CLOSURES

This application is a continuation-in-part and claims priority of U.S. patent application Ser. No. 7/147,267, filed Jan. 22, 1988, now U.S. Pat. No. 4,804,106 which was a continuation-in-part and claimed priority of International Application Ser. No. PCT/US87/03418, filed Dec. 23, 1987 which was a continuation-in-part and claimed priority of International Application Ser. No. PCT/US87/02649, filed Sept. 29, 1987 which was a continuation-in-part and claimed priority of International Application No. PCT/US87/00102, filed Jan. 23, 1987.

This invention relates to end closure structure providing abuse-resistance in combination with controlled opening of a full-panel convenience-feature along with raw-edge metal shielding during and subsequent to opening; and, is concerned with methods and apparatus for fabrication of such closure structures in addition to opening methods.

In particular, this invention is concerned with providing a full-panel, convenience-feature end closure made from steel which can be readily opened while also providing shielding for raw edge residual scoreline metal to provide an improved type of protection not previously available in such full-panel easy-open art. In addition, this invention is concerned with providing increased strength for sheet metal easy-open end closures for protection against abuse during transportation, warehouse stacking and market handling.

The above and other contributions are considered in more detail in describing embodiments of the present invention shown in the accompanying drawings.

Figure 1:
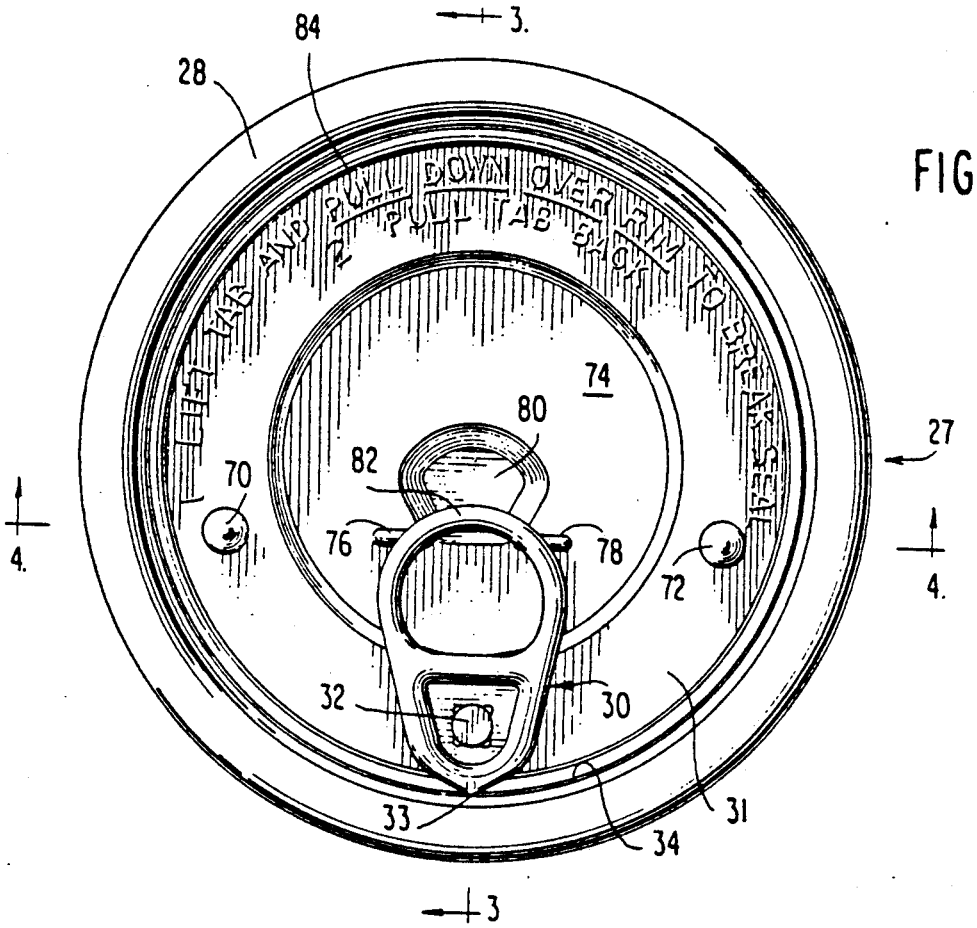
FIG. 1 is a plan view of the exterior (public side) of an end closure structure embodying the invention.
Figure 3:
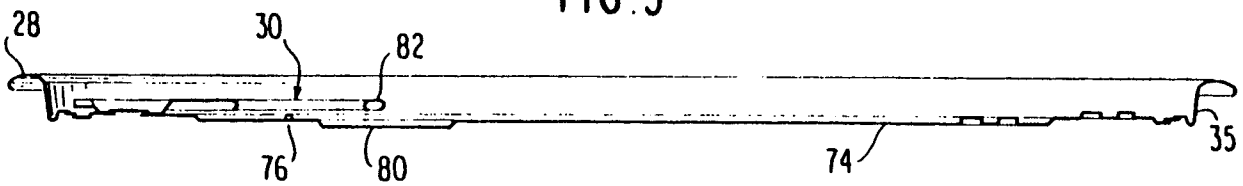
Figure 4:
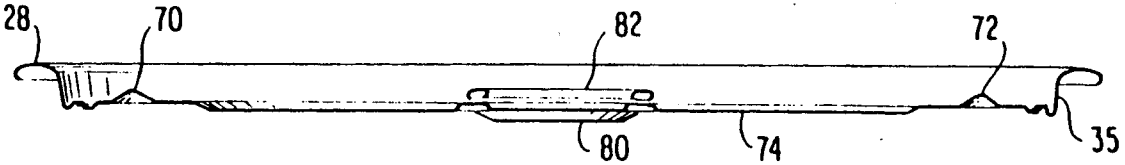
Figure 6:
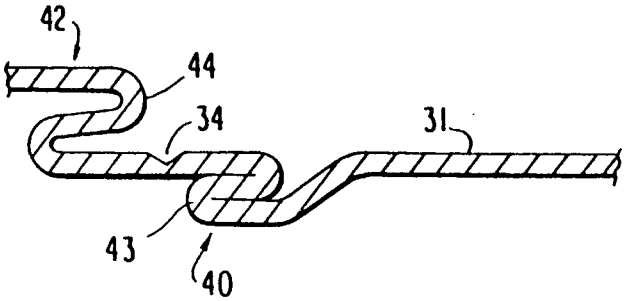
Figure 5:
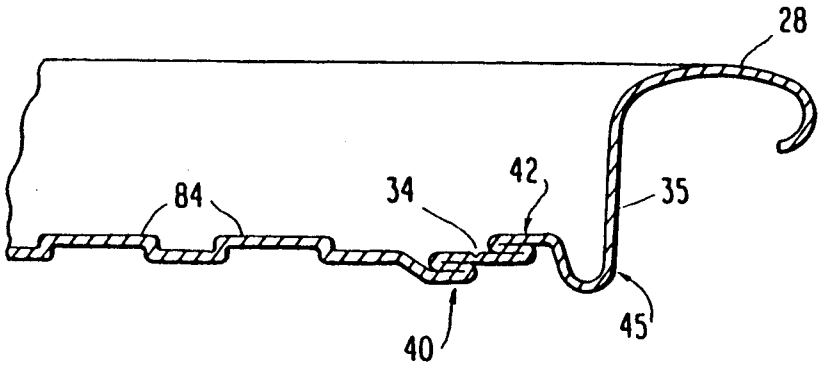
Figure 7:
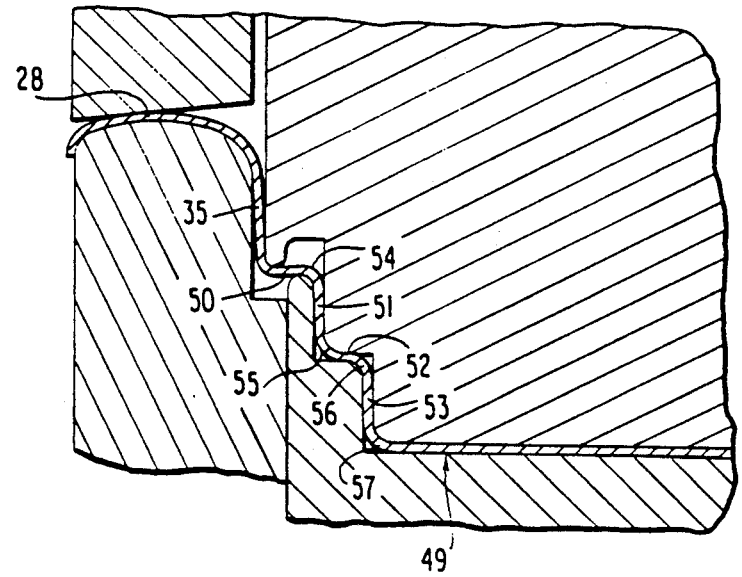
Figure 8:
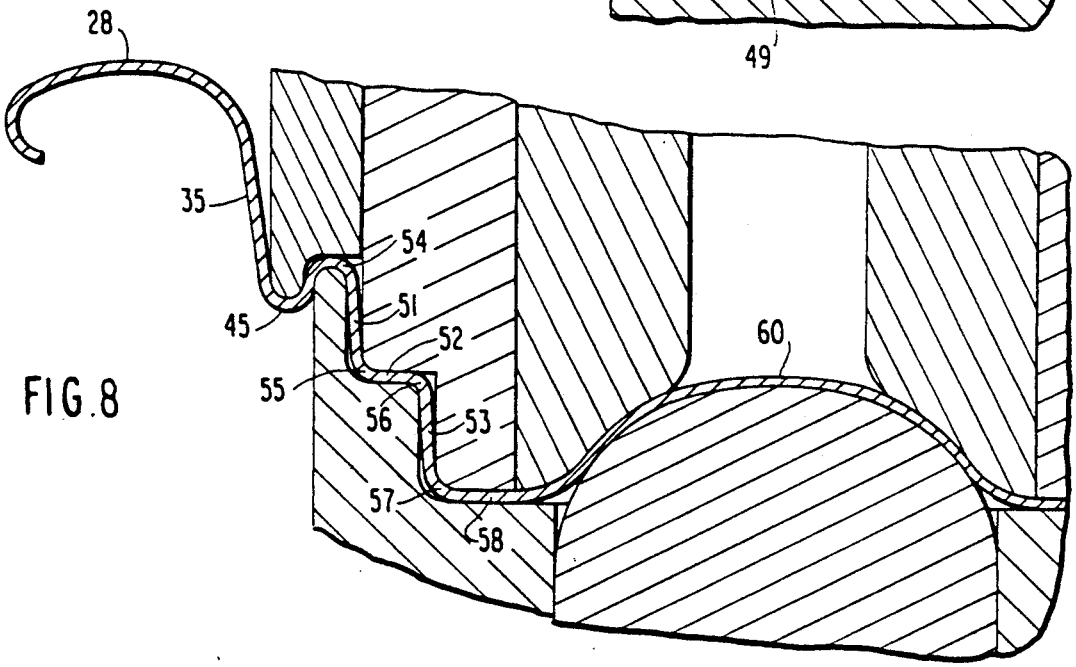
Figure 9:
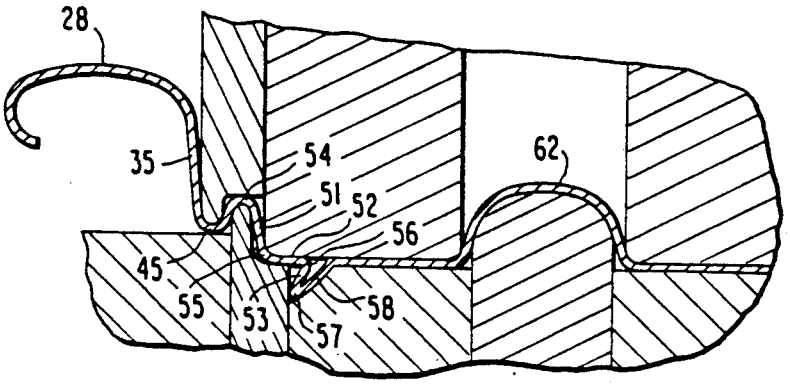
Figure 10:
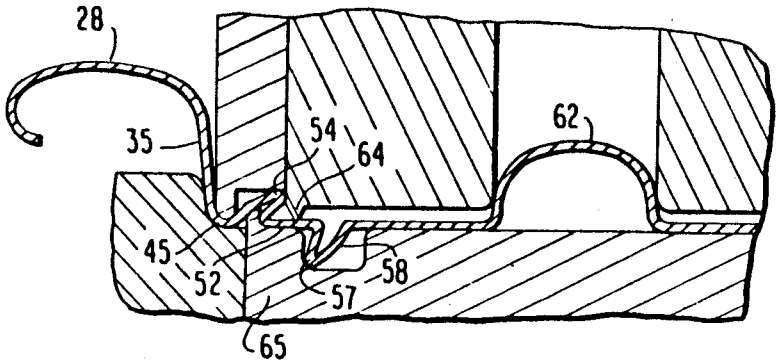
Figure 12:
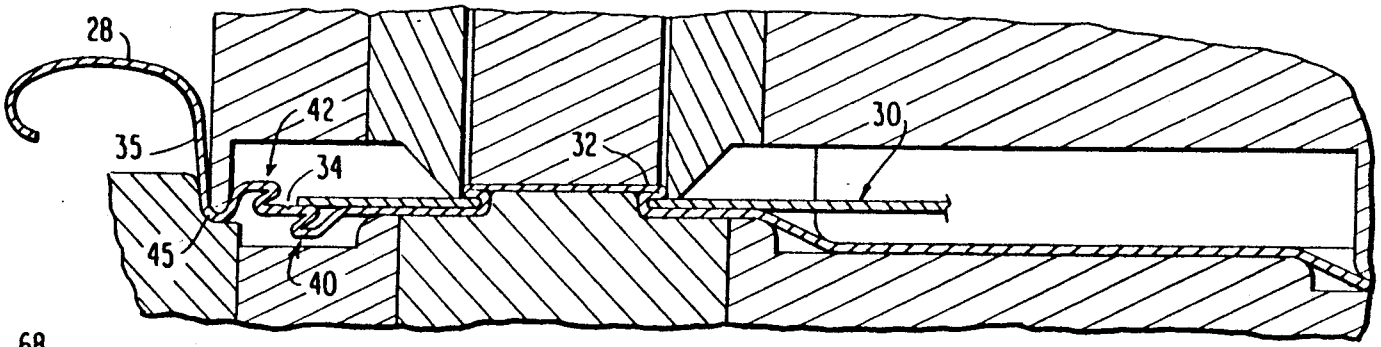
Figure 11:
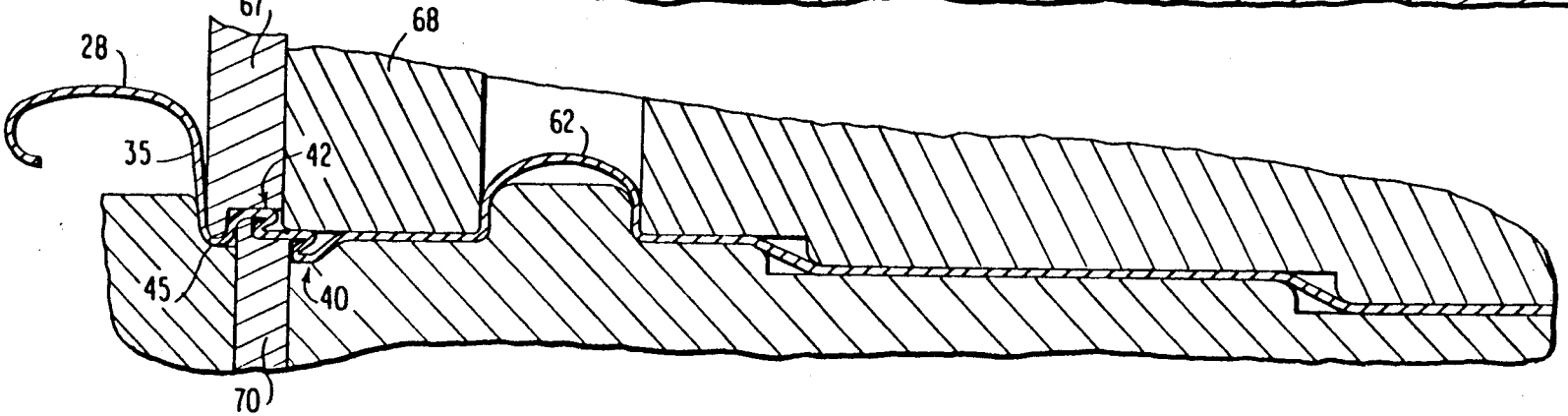
Figure 13:
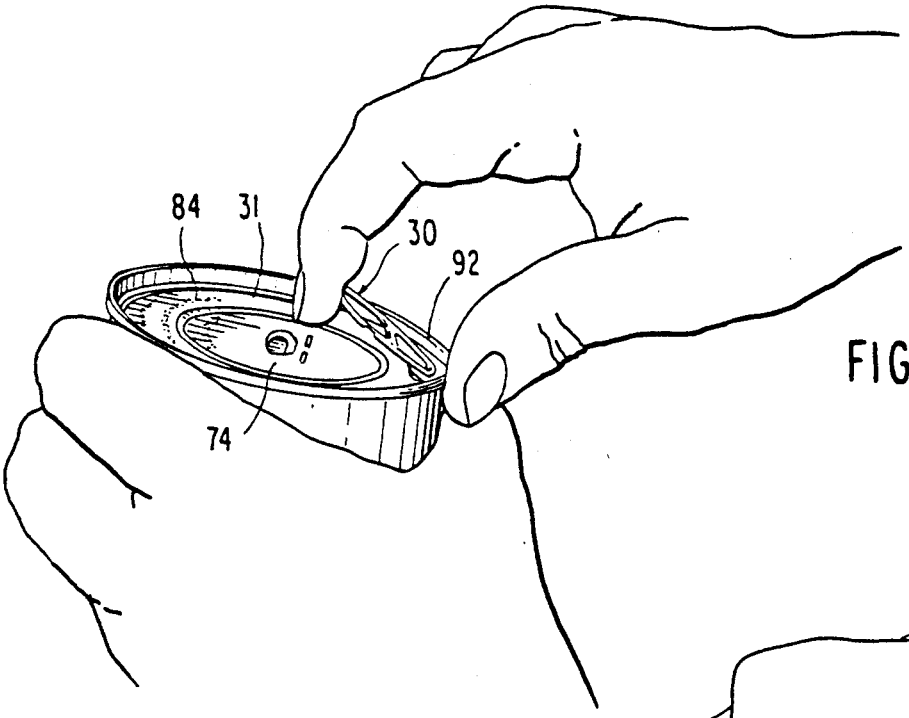
Figure 14:
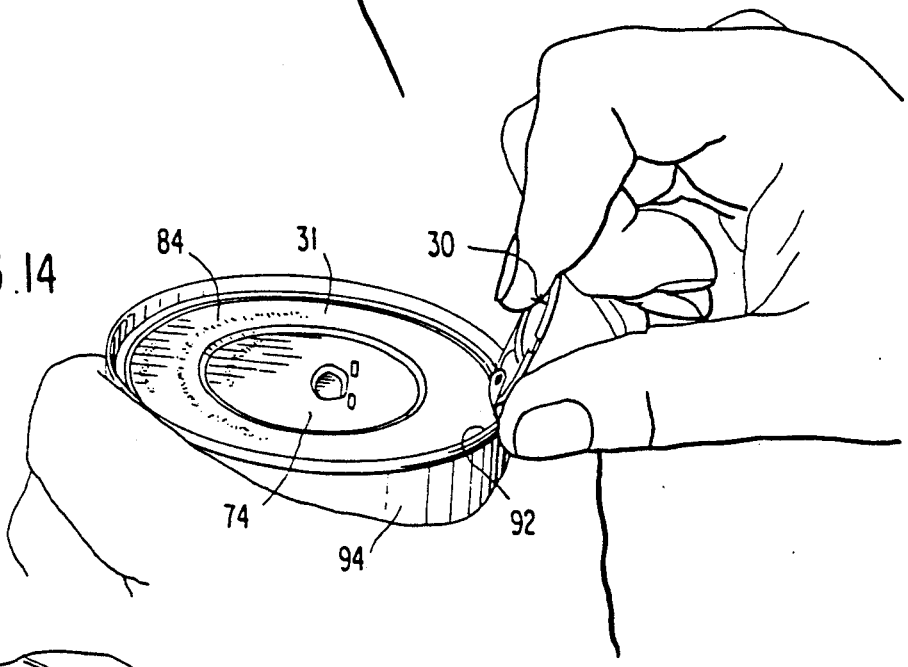

FIGS. 3 and 4 are radial cross sectional views of the end closure structure of FIG. 1 along lines 3—3 and 4—4, respectively;

FIG. 5 is an enlarged view of a portion of the radial cross sectional view of FIG. 3 at a location diametrically opposite to the position of an integral opener for such end closure;

FIG. 6 is an enlarged cross section schematic view of a portion of an end wall panel for purposes of describing interrelated placement of portions of an end closure structure for operation of the working end of an integral opener as taught by the invention;

FIGS. 7–12 are cross-sectional views of tooling and end closure structure for purposes of describing sequential fabrication steps, in which:

FIG. 7 shows results of a blank forming stage,

FIG. 8 shows initial configuration formation of a shallow depth rivet button and a peripheral shock-absorbing bead, FIG. 9 shows further forming of the rivet button and initiation of pre-folding of an inner multi-layer sheet metal fold for shielding residual torn metal remaining with a removable panel portion, FIG. 10 shows scoring of the end wall panel and initiation of pre-folding of an outer multi-layer sheet metal fold for shielding residual torn metal remaining with the container, FIG. 11 shows completion of such multi-layer sheet metal folds and forming profiling in a panel portion, and FIG. 12 shows completing formation of the rivet securing an opener to the end wall panel; and FIGS. 13 through 17 are perspective views of the end closure embodiment of FIG. 1 and a portion of a container for describing the opening procedure taught by the present invention.

In any of the known prior art "disc pull-out" ends, only a minor portion of the peripheral scoreline was ruptured by lever action. Such rupturing took place initially when the opener was lifted. Thereafter, the remainder of the peripheral scoreline was separated by pulling backwardly on the ring-pull of the opener. In general, such previously available disc pull-out ends were forced to rely on folding the removable disc over (onto itself) so that the residual metal along the remainder of the peripheral scoreline could be "torn," as the opener was pulled backwardly-diametrically across the center of the end wall after the initial rupture.

In general, most such full-panel easy-open ends have used "lanced" openers in which the handle end of the opener was free to be lifted away from the panel while a riveted portion of the opener remained coplanar with the panel as riveted. However, when a "vent scoreline" was used in certain prior "disc pull-out" end closures, a longitudinally-rigid (lance-free) opener was used to rupture the vent portion of the back scoreline and provide for movement of the ring-pull opener from a radially-recessed position which was required for chuck tooling access for chime seam formation.

Features of the present invention maintain the removable disc substantially planar and rigid throughout the opening procedure for the container. Also, the substantially rigid end wall panel provided contributes to the continuing lever-action opening features made available by the invention. And, an accurate interrelated positioning of parts facilitates ease of initial rupture of the high-strength abuse-resistant ends provided.

Figure 2:
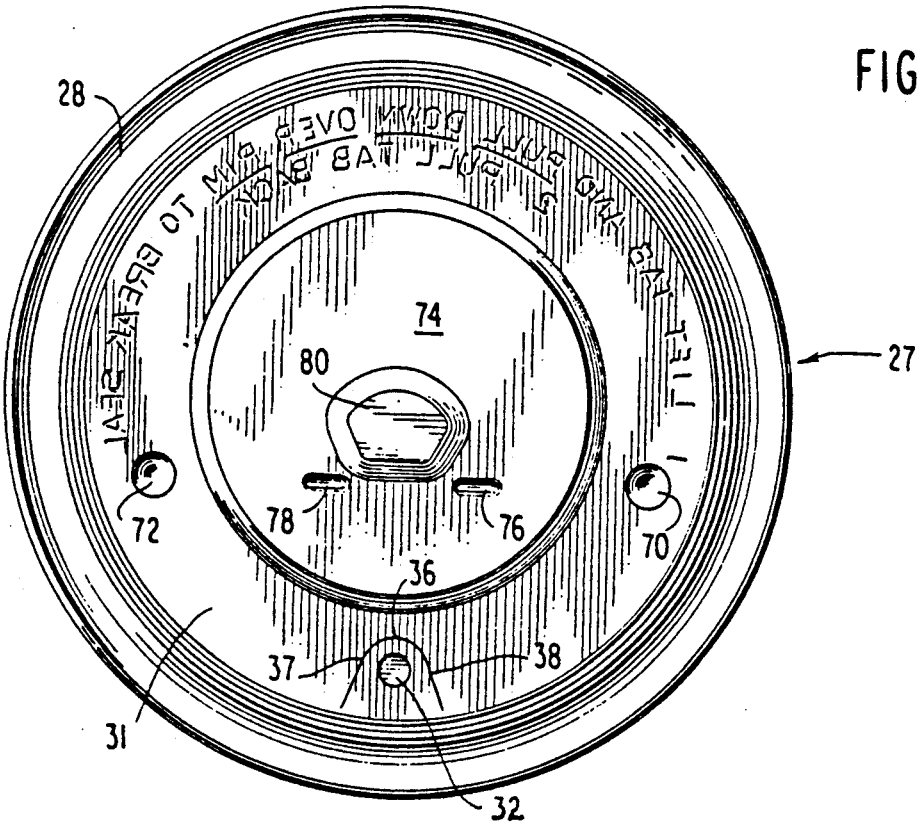
FIG. 2 is a plan view from the interior (content side) of the end closure of FIG. 1.

In the circular-configuration embodiment of FIGS. 1–5, end closure structure 27, shown in plan view of its exterior (public side) in FIG. 1, and in plan view of its interior (content side) in FIG. 2, is formed with chime seam metal 28 around its circular periphery. A longitudinally-rigid (non-lanced) opener 30 (FIG. 1) is secured to removable disc 31 by rivet 32. The working end 33 of the elongated integral opener 30 is positioned in contiguous relationship to a portion of peripheral scoreline 34; the latter, as shown and generally preferable, has a circular configuration in plan view and defines the removable disc 31 portion of the recessed end wall panel of closure structure 27.

The cross section views of FIGS. 3 and 4 are taken along the full diameter of FIG. 1; FIG. 5 is an enlarged cross sectional view of a portion of FIG. 3 diametrically opposite to the location of the working end 33 of opener 30. Peripheral scoreline 34 is spaced radially inwardly from chuck wall 35 toward the central longitudinal axis for a container shown in later figures; such axis passes through the geometric center of the removable disc 31 and end closure structure 27.

A curvilinear vent scoreline portion 36 (FIG. 2) of the back scoreline means partially circumscribes rivet 32. Such back scoreline means continues along legs 37, 38; with one each extending on opposite sides of the rivet with each having a major component of direction which is radial. As taught herein, the back scoreline means is arch-shaped in configuration as shown in the embodiment of FIG. 2 and later figures; the arch-shape provides an added safety feature improvement over the moustache shaped back scoreline configuration previously provided and described in prior application Ser. No. 07/147,267, filed Jan. 22, 1988.

In a preferred embodiment of the present invention, a multi-layer fold of sheet metal is positioned on each cross-sectional side of peripheral scoreline 34 (FIG. 5). Each such multi-layer sheet-metal fold acts to shield the raw edge residual metal remaining after severing along a peripheral scoreline. A triple-layer fold of sheet metal, as described in more detail later herein, is adequate and is preferred to accomplish such purposes.

Triple-layer metal fold 40 (FIG. 6) remains with the severable portion 31 (disc shaped in the embodiment of FIGS. 1-5) upon and after severing along a peripheral scoreline 34. Triple-layer fold 42, which is positioned outwardly of the scoreline 34, and in accordance with a preferred embodiment of the invention on the exterior surface (public side) of the end closure structure 27, remains with that portion of the end closure structure remaining with the container upon and after severing of scoreline 34.

The configuration and placement of the arch-shaped back scoreline means (as seen in FIG. 2 and later figures), along with other parts of the end closure structure, play important roles in the interaction of unitary and integral portions which facilitate ease of opening. Tearing along leg portions 37, 38 of the back scoreline means, after rupture of the curvilinear vent portion 36 would ordinarily cause lance-free opener 30 to move outwardly (with a radially directed component of movement in the circular embodiment of FIGS. 1-5). Part of the invention teaches positioning a formed, unitary portion of end wall metal to accurately control (by stopping) such movement of the opener and to direct the opening force of its working end 33 toward a location, within prescribed limits, which facilitates initial rupture of the peripheral scoreline 34.

Positioning of the rounded-edge transition zone 44 of multi-layer fold 42 (FIG. 6 enlargement controls any movement of the opener 30 and directs the opening force of its working end 33 toward the peripheral scoreline 34.

The rounded transition zone metal 43 of the multi-layer fold 40 is positioned oppositely but contiguous to the location of the peripheral scoreline 34. In a circular embodiment, rounded transition zone metal 43 has a predetermined diameter (measured in the plane of the end wall) which approximates, but is less than, the diameter of the rounded-edge transition zone metal 44 of multi-layer sheet-metal fold 42. The apex of scoreline 34 (at which rupture occurs) can also approximate, but is less than the circumference of transition zone metal 44. These teachings avoid attempting to remove an end wall disc having a greater circumference than that of the metal at zone 44.

Rounded metal 43 is positioned to shield the raw-edge residual metal remaining with disc 31 by at least partially obstructing access of such torn edge metal. The torn portion of the peripheral scoreline 34 (at the apex of the "V" shaped radial cross-sectional configuration of the scoreline) has a diameter which can be approximately equal to that of rounded edge metal 43 of the transition zone for multi-layer fold 40 but, as pointed out immediately above, must be less than that of rounded edge metal 44 of the outer barrier-means multi-layer sheet metal fold 43; otherwise, edge 44 would block removal of a disc which presented metal of larger diameter.

There is a range for application of an initial rupturing force which, to facilitate ease of opening, particularly in opening a steel end closure, is measured in thousandths of an inch for typical consumer-size cans, such as a three-inch diameter can. This range takes into account an arcuate path movement for the working end of the opener and, the "V" shaped configuration, in cross section, of the peripheral scoreline. Controlling movement of the integral opener so as to guide its working end 33 to contact the end wall panel within an acceptable range, as taught herein, is carried out by positioning the multi-layer fold 42 so as to act as a barrier in which edge 44 stops radial movement of opener 30 and direct its working end 33 inwardly (in relation to a container) toward such peripheral scoreline 34 in the recessed end wall panel.

The scoreline 34 has a diameter (where rupture occurs) which approximates or is slightly greater than that of the transition zone metal 43 of multi-layer folds 40. The open end of "V" shaped (in cross section) scoreline 34 is between about five and about ten thousandths of an inch in radial dimension. For example, scoring 0.006" deep with a scoring tool having a 50° included angle results in the open end of the "V" having a radial dimension of 0.0056"; and, scoring 0.009" deep with a scoring tool having a 60° included angle results in an open end having a radial dimension of 0.0104". The working end of the opener is turned inwardly toward the recessed end wall panel by preventing radial movement of such working tip of the opener in the plane of, or parallel to the plane of, the end wall panel. The location of the barrier means, multi-layer fold 42 is selected to take into account the angled movement of the working end 33 toward scoreline 34.

By stopping the horizontal (radial) component of movement, the lever-action opening force is thus directed vertically downwardly toward the scoreline 4. In accordance with present teachings, the radial distance between rounded edge 43 (approximately the same location as center of scoreline 34) and the barrier location of rounded edge 44 can be in a range between about five and about twenty thousandths of an inch for an end wall closure structure for a three (300) to a three and seven-sixteenths (307) inch diameter container in which the end wall comprises flat rolled steel of about 0.008" to 0.010" nominal thickness gage. By preventing radial movement of the opener beyond such range, its working end will be turned, toward the end wall panel into, or sufficiently adjacent to, the open end of the peripheral scoreline to facilitate ease of opening.

Positioning the barrier-means edge metal 44 beyond the earlier designated range (closer to shock-absorbing bead 45 which is contiguous to chuck wall 35, FIG. 5) will diminish the ease of opening, if not make opening substantially impossible for a consumer of average strength.

Along with such interrelated positioning of parts, the new combination of steps taught provides in combination abuse resistance, controlled movement of the opener and shielding of raw edge metal features while still providing access and timing, during sequential fabrication steps, for efficient and effective peripheral scoreline and rivet button formation.

In FIG. 7, the sheet metal is blanked and an end panel 49, inboard of chuck wall 35, is countersunk in relation to chime metal 28. A peripheral rim 50 is formed contiguous to chuck wall 35 for subsequent formation of shock-absorber bead 45 (as shown in FIG. 5, the outboard leg of such "U" shaped bead is an extension of chuck wall 35). From rim 50 a series of sheet metal portions, riser 51, step 52 and riser 53, extend in stepped fashion to recessed panel 49 which has an extended-planar-surface area.

Such riser and step sheet metal portions are joined by transition zones 54, 55, 56 which are of compound-curvature in a circular configuration embodiment with each being curvilinear in radial cross section and also around its respective circumference in a plane which is perpendicularly transverse to the central longitudinal axis for a container to which the end closure structure is attached. Such steps and risers, along with the transition zones participate in formation of the double multi-layer sheet metal folds 40, 42 formed during the sequences of FIGS. 8–12. Rim 50 leads through zone 54 to riser 51, which leads through zone 55 to step 52. The latter leads through zone 56 to riser 53 which leads through zone 57 to portion 58 of the recessed end wall panel.

In carrying out the procedures of FIGS. 8–12, the timing of the shock-absorbing bead formation, rivetbutton formation, the multi-layer folding action, and the extent to which multi-layer sheet metal pre-folding is carried out prior to formation of the peripheral scoreline 34, are important considerations along with the timing of end wall profiling formation in relation to securing an integral opener.

The peripheral scoreline 34 for the removable disc 31 is to be disposed in the end wall panel 49 intermediate the pair of multi-layer folds (FIGS. 5, 6) each of which separately shield residual scoreline metal on the separated disc and on the container. The forming sequence procedure taught enables tooling access, between the multi-layer pre-folds on each surface of the end closure, to enable scoring of a single thickness of sheet metal while the latter is supported on the remaining surface opposite to the scoring tool. The forming of the shock absorbing bead, pre-folding of the sheet metal layers and preforming the rivet button prior to scoring, enables completing the folding action, around such periphery, with minimized movement of sheet metal folds being required after such scoring so as to substantially preclude premature damage to residual scoreline metal.

In the operation of FIG. 8, an initial rivet button configuration 60, having a broad-diameter shallow-dome shape in cross section, is formed. Also, the sheet metal of peripheral rim 50 is pre-formed into shock-absorber bead 45. Step portion 52 is oriented horizontally as shown. Peripheral scoring (34) will subsequently take place on such horizontally oriented metal portion 52 of the end wall panel 49. Such horizontally-oriented metal portion 52 is to be located so as to interconnect the pair of multi-layer folds 40, 42.

Shock-absorbing bead formation, the stages of multi-layer folding of the sheet metal, scoreline formation, the stages of rivet button formation, profiling, riveting an opener to the removable panel portion, and embossing opening instructions are coordinated while optimizing the number of sequential steps. In addition to the above enumerated advantages of scoring a single layer of metal and avoiding premature damage to residual scoreline metal, the rivet button formation and riveting actions are carried out without interfering with the metal folding or scoring operations. Embossing opening instructions can be carried out simultaneously with formation of the rivet button and the profiling including recessed finger access, as described later herein.

The shock-absorbing bead (45) as initially preformed (FIG. 8) is loosely defined. Also, start of the movement of metal, including transition zone 54 and a portion of riser 51, which will comprise a part of the outer multi-layer fold, is taking place.

In FIG. 9, a smaller-diameter, greater-depth rivet button 62 is formed and the pre-folding of metal portions for the inner multi-layer fold (40), that is riser portion 53 and a portion 58 of the end wall panel 49 contiguous to transition zone metal 57, are initiated.

In FIG. 10, the sheet metal portion 54 of FIG. 9, along with a portion of riser 51 are moved so as to partially form the outboard multi-layer sheet metal fold (42) while leaving access for scoring tool 64 to form peripheral scoreline 34 in the exterior (public) surface of the end wall panel 49 (thus defining the removable portion 31); while on the interior (content) surface of the end closure back-up tool 65 has access past the inboard multi-layer fold (40) which is being formed.

In FIG. 11, the peripherally-located shock-absorbing bead 45 is better defined in a portion of peripheral rim 50 by tool 66; and the outboard multilayer fold is better shaped by tool 67 which tool helps to define the location of the radially-inwardly oriented transition zone metal (44 of FIG. 6). Tool also helps to locate such transition zone 44 while tool 70 helps to position transition zone 43 (of fold in FIG. 6) as the multi-layer folds are being formed in final orientation. The shape of the rivet button 62 is held by the tooling shown; and end wall panel profiling is being carried out.

In FIG. 12, while maintaining the shock-absorbing bead 45 and protecting sheet metal folds 40, 42, the rivet button of FIG. 11, after receiving opener 30, is formed into rivet 32.

The registration and stacking protrusions 70, 72 (FIG. 1) are formed in the initial blanking stage. The profile risers 76, 78 and finger indentation 80, to improve finger access beneath handle end 82 of opener 30, are formed in a subsequent sequence, prior to placement of the opener 30 for riveting, along with embossing of opening instructions 84.

Profile risers 76, 78 serve the function of holding the non-lanced opener 30 substantially parallel to the generally planar configuration of the end wall panel 49 for riveting. Such risers and the finger indentation 80 are formed in the centrally located recessed profile 74 of the end wall panel 49.

Back scoreline formation preferably takes place during formation of peripheral scoreline 34. The arch-shaped back scoreline configuration of FIG. 2 which provides a chord of about 0.05" length between legs 37, 38 is preferred. This pre-selected chord length and the arch-shape segment defined by the back scoreline prevents any raw edge portion of the segment from extending over the side of the chime seam, thus preventing a hazard to safety. The pre-selected halfinch chord length is also the approximate width of opener 30 at that location.

As referred to briefly earlier, upon initial lifting of the handle end of opener 30 (FIG. 13) in an arcuate direction externally away from the end closure, the vent portion 36 of the back scoreline ruptures relying on Class II lever action. With continuing arcuate movement, the back scoreline legs 37, 38 rupture toward the adjacent inner multi-layer sheet metal fold 40. The opener 30, with an endwall portion partially defined by the back scoreline, pivots about the chord defined by the intersection's back scoreline legs 37, 38 at 88 and 90 (FIG. 15).

Figure 15:
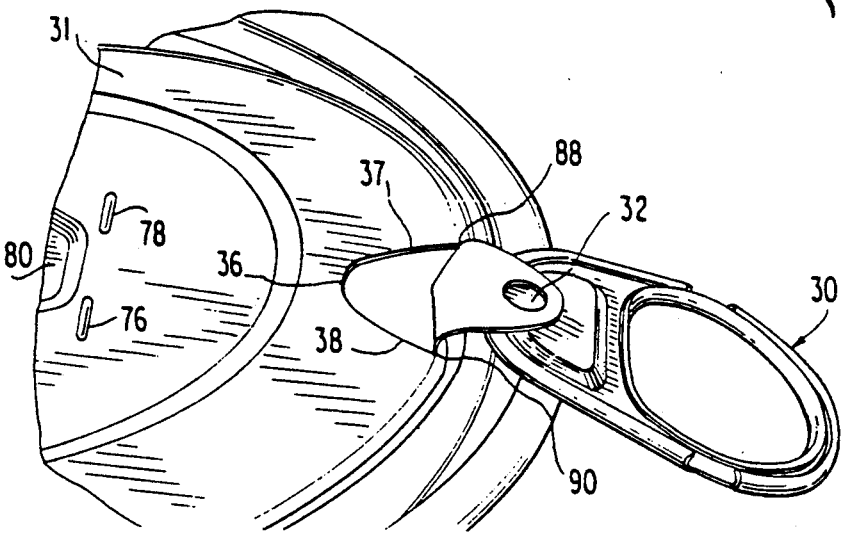

The arcuate direction movement of the handle end of the opener 30 is continued in the same direction with the opener initially contacting (FIG. 14) chime 92 (formed from chime metal 28 and sidewall metal of container 94) which then acts as the fulcrum for Class I lever action opening, as the opener is swung over the side of container 94 (FIG. 15).

As indicated by FIG. 16, this "over the side" arcuate movement continues rupture of a significant major portion of peripheral scoreline 34 by Class I lever action about chime 92 as fulcrum. It should be noted in relation to FIG. 16, that none of the segments of the disc defined by the arch-shaped scoreline extends over the side of the container, as occurred with corner portions of such segment when formed from a moustache-shaped scoreline as previously provided. This arch-shaped scoreline has a preselected chord length as shown (between 88, 90) which is no greater than the width of the opener at such location overlying such chord; such preselected chord length (about 0.50") can be maintained for differing sized containers.

After such peripheral scoreline rupture, the removable disc is lifted from container 94 as shown in FIG. 17.

In a typical end closure structure for a three and 7/16 inch diameter (307) can body side wall made from flat rolled steel (75 #/66, about 0.008" nominal thickness gage) metal plated and coated with a standard organic coating, the following data are representative:

| Item | Diameter |
|---|---|
| Chime metal 28 | (C.L.) 3.50" |
| Chuck Wall 35 | 3.25" |
| Bead 45 | (C.L.) 3.22" |
| Transition zone 44 | (ref.) 3.078" |
| Scoreline 34 | (C.L.) 3.068" |
| Transition zone 43 | (ref.) 3.064" |
| Rivet 32 | (C.L.) 2.443 |

Other representative dimensions:

| Item | Dimensions |
|---|---|
| Bead 45 | |
| (depth) | .035" |
| (width) | .050" |
| Chime metal 28 (Center Height above bottom of bead 45) | .150" |
| Rivet 32 | |
| (head diameter) | .250" |
| (body diameter) | .166" |
| Chord length (between legs 37, 38 at intersections 88, 90) | .050" |
| Profiling panel 74 (diameter) | 2.00" |
| Axial dimension between center of chime seam metal 28 and panel 49 (FIG. 7) | .390 |

Typical thicknesses for flat rolled aluminum end closures would be 0.009" to 0.012" with residual metal thickness for scored severing lines of about 0.004" to 0.005".

While specific values, materials, and configurations have been shown for purposes of specifically describing an embodiment of the invention, other values will be available in the light of the above teachings; therefore, for purposes of determining the scope of the present invention reference should be made to the appended claims.

I claim:

1. Full-open, safety-edge, disc-removal, convenience-feature sheet metal end-closure structure, comprising an end wall panel (49) circumscribed by unitary chime seam metal (28) for attaching the end wall closure structure (27) to a container having a configuration which is symmetrical about a central longitudinal axis for container (94) with the central longitudinal axis intersecting the end closure panel (49) at its geometric center when the end closure structure (27) is attached to the container (94), such end wall panel being recessed axially in relation to such chime seam metal toward the interior for such a container, a bead (45) which is "U" shaped in cross section in a plane which includes such central longitudinal axis and having its closed end disposed axially inwardly toward the interior of the container (94) with an inboard and outboard leg of such U-shaped bead extending outwardly from such closed end, chuck wall (35) which is symmetrically disposed in relation to the geometric center or one panel (49) and extends in the axial direction from the chime seam metal (28) toward the axially-recessed end wall panel (49) with the outboard leg of the bead (45) forming an extension of the chuck wall (35), a peripheral scoreline (34) spaced inboard of the chuck wall (35) and "U" shaped bead (45) toward the geometric center of the end wall panel (49) defining a removable end wall disc (31) for providing an opening in the end closure structure (27) to facilitate full removal of container contents, a multi-layer sheet metal fold (40) located on the interior surface in relation to container (94) and circumscribing the removable end wall disc (31) contiguous to the peripheral scoreline (34) in a position to shield raw edge residual metal of peripheral scoreline (34) upon rupture thereof, an elongate longitudinally-rigid opener (30) secured by a unitary rivet (32) to the removable disc (30) contiguous to and in substantially parallel relationship to such generally-planar configuration of the end wall panel (49) with the longitudinal axis of the elongate opener (30) being oriented toward the peripheral scoreline (34) with the working end (33) of the elongate opener (30) contiguous to the peripheral scoreline (34), a multi-layer sheet metal fold (42) located outboard of and contiguous to the peripheral scoreline (34) on the exterior surface of the end wall pane (49) in relation to container (94) providing shielding for raw-edge residual scoreline metal remaining with the container (94) and also providing a barrier to outboard-directed movement of the elongate opener (30), with such multi-layer sheet metal fold (42) being located inboard of the shock-absorbing bead (45) so as to direct the working end (33) of the opener (30) toward the recessed panel (49) and the peripheral scoreline (34) which is disposed in such recessed panel (49) intermediate a projection of such multi-layer folds (40, 42) on such recessed panel (49) to initiate rupture of a minor portion of the peripheral scoreline (34) by Class I lever action, an arch-shaped back scoreline means having a central portion (36) partially circumscribing and located inboard of the rivet (32) toward the geometric center of end wall panel (49) with a leg (37, 38) extending from the central portion (36) on each side of the rivet (32), each such leg having a major directional component toward the adjacent portion of the inner shielding multi-layer sheet metal fold (40) to form a chord of preselected length between intersections (88, 90) with the multi-layer sheet metal fold (40) on the end wall disc (31), the central portion (36) of the back scoreline means being ruptured by Class II lever action upon initial movement, about such unitary rivet (32) as a fulcrum, of the handle end (33) of the opener (30) with the handle end moving in a direction away from the end wall panel (49) in an arcuate path extending externally of the container (94) causing rupture along the back scoreline legs (37, 38() with the intersections (88, 90) with fold (40) forming a fulcrum axis for continued arcuate direction movement of the elongate opener (30) to bring about contact of opener (30) with the chime seam metal (28) which acts as a fulcrum for continued Class I lever action opening which moves at least a portion of the removable disc (31) in an axial direction externally away from the container (94) to continue rupture of the peripherally located scoreline (34).

2. The structure of claim 1 in which the peripheral scoreline (34) presents a substantially circular configuration in plan view, and each multi-layer fold (40, 42) of sheet metal is of substantially circular configuration in plan view and is in contiguous relationship to the peripheral scoreline (34), with each multi-layer fold (40, 42) presenting a rounded-edge transition zone (43, 44) having a circumference approximating that of the peripheral scoreline (34) with the rounded edge transition zone (44) on the exterior of the end wall panel (49) having a preselected minimum circumference which is greater than the circumference of the peripheral scoreline (34), and the rounded edge transition zone (43) on the interior of the end wall panel (49) having a preselected maximum circumference which is less than the circumference of the exterior rounded transition zone (44).

3. Method for fabricating an abuse-resistant, full-panel, convenience feature end closure structure (27) for a cylindrical sidewall configuration container (94) from flat-rolled sheet metal so as to provide shielding for residual raw edge metal remaining after severing a circular-configuration peripheral scoreline (34) defining such full-panel opening for such container, comprising forming chime seam metal (28) about the periphery of a substantially-planar flat-rolled sheet metal blank for attaching end closure structure (27) to a cylindrical sidewall container (94), and countersinking an end wall panel (49) in the sheet metal blank radially inward of the chime seam metal (28) and disposed axially toward the interior of the container (94) from chime seam metal (28) with the countersinking step defining:

a substantially cylindrical-configuration chuck wall (35) contiguous to and extending from the chime seam metal (28) in the axial direction toward the interior of container (94), a peripheral rim (50) of sheet metal contiguous to chuck wall (35) and in substantially parallel relationship with the countersunk end wall panel (49), and an intermediate configuration which is stepped in radial cross section in extending between the peripheral rim (50) and the countersunk end wall panel (49), with the stepped configuration including a plurality of unitary sheet metal angled relationship to each other with a compound curvilinear transition zone located at the peripheral rim (50), between each pair of angled sheet metal portions, and at the end wall panel (49), forming a bead (45) which is "U" shaped in cross section in the peripheral rim (50), with the closed end of the "U" shaped bead (45) being disposed toward the interior of container (94), establishing an orientation which is substantially perpendicularly transverse to the container central axis for a sheet metal portion (52) located intermediate other angled sheet metal portions (51, 53) of the stepped configuration between the "U" shaped bead (45) and the countersunk end wall panel (49), the intermediate sheet metal portion (52) being established for locating a circular-configuration scoreline (34) therein on its exterior surface for defining the periphery of a disc (31) to be removed from the end closure structure (27), with the remaining angled sheet metal portions (51, 53) being located radially inboard and outboard of the intermediate sheet metal portion (52), orienting angled sheet metal portions located radially on each side of such intermediate sheet metal portion so as to be in acute-angled, overlaying, pre-folded relationship to each other to provide for a pair of multi-layer folds (40, 42) of sheet metal, with the pre-folding orientation of such multi-layer folds of sheet metal being carried out to locate one each of such pair on opposite sides radially of a predetermined location for such circular-configuration peripheral scoreline (34) to be located on such intermediate sheet metal portion (52) and to locate one each of such pair on opposite surfaces of such end wall panel (49) so as to allow access for a scoring tool (64) on one surface and access for a backing-support tool (65) for such scoring on the remaining surface of the intermediate sheet metal portion (52), pre-forming a rivet button (62), for use in securing an opener (30) to end wall panel (49) during the pre-folding orientation of the multi-layer folds (40, 42) of sheet metal, then forming the circular-configuration peripheral scoreline (34) to substantially uniform depth in the intermediate sheet metal portion (52) while providing access between the multi-layer sheet metal folds (40, 42) as pre-folded for a scoring tool (64) on such exterior surface and for backing support tool (65) on the interior surface of such end wall panel, forming an arch-shaped back scoreline means having a central portion (36), at least partially circumscribing the rivet button (32) radially inwardly thereof, and a leg (37, 38) extending from the central portion (36) on each side of the rivet button (32) in the direction of an adjacent portion of the chime seam (92) with the effective included angle between the directions for the legs (37, 38) being an acute angle, and completing disposition of the angularly prefolded folded sheet metal portions in relation to the peripheral scoreline (34) such that one each of the compound-curvilinear transition zones (43, 44) defines a circular configuration in plan view which is contiguous on its respective surface of the end wall panel (49) to the circular configuration peripheral scoreline (34).

4. The method of claim 3 in which the elongate longitudinally-rigid tab opener (30) is secured to the end wall panel (49) with its working end (33) contiguous to the peripheral scoreline (34) using the rivet button (62) which is unitary with such end wall panel by placing a rivet button opening of opener (30) over the rivet button (62) and forming the rivet button (62) into rivet (32) to make the opener (30) integral with the removable disc (31) with the longitudinal axis of elongate opener (30) being disposed to be coincident with a diameter of end wall panel (49), and in which the transition zone (44) on the exterior surface of the end wall panel (49) is located to act as a barrier to radial movement of the integral opener (30) and to direct the working end ( 33) of opener (30) inwardly of container (94) toward the peripheral scoreline (34).

* * * * *